US005499459A

United States Patent [19]

Tomaro

[11] Patent Number: 5,499,459

[45] Date of Patent: Mar. 19, 1996

[54] FOOTWEAR WITH REPLACEABLE, WATERTIGHT BOOTIE

[75] Inventor: Rita Tomaro, Nashua, N.H.

[73] Assignee: H. H. Brown Shoe Company, Inc., Greenwich, Conn.

[21] Appl. No.: 319,120

[22] Filed: Oct. 6, 1994

[51] Int. Cl.[6] ..... A43B 23/07

[52] U.S. Cl. ..... 36/10; 36/55

[58] Field of Search ..... 36/55, 10, 51, 36/100, 83, 88; 2/239; 12/142 P

[56] References Cited

U.S. PATENT DOCUMENTS

| | | | |
|---|---|---|---|
| 272,470 | 2/1883 | Pond | 36/10 |
| 2,238,804 | 4/1941 | Brown | 36/10 |
| 2,422,410 | 6/1947 | Gross | 36/10 |
| 3,243,901 | 4/1966 | Clarizio | 36/10 X |
| 4,069,600 | 1/1978 | Wise | 36/10 |
| 4,187,619 | 2/1980 | Gibbs | 36/10 |
| 4,192,086 | 3/1980 | Sichak | 36/44 |
| 4,575,954 | 3/1986 | Bye | 36/89 |
| 4,706,316 | 11/1987 | Tanzi | 36/55 X |
| 4,809,447 | 3/1989 | Pacanowsky | 36/10 X |
| 5,353,524 | 10/1994 | Brier | 36/55 |
| 5,402,540 | 4/1995 | Williams | 36/10 X |

*Primary Examiner*—Paul T. Sewell
*Assistant Examiner*—Ted Kavanaugh
*Attorney, Agent, or Firm*—Fish & Richardson

[57] ABSTRACT

An article of footwear includes an outer boot or shoe with a sole and an upper, which together define a volume for receiving and protecting a wearer's foot against external elements, and a replaceable, watertight bootie sized and shaped to fit snugly within the volume. The bootie includes an insole, a bootie upper, and releasable attachment elements for releasable securement of the bootie within the volume. The bootie has a waterproofing layer of material impervious to penetration by water that provides protection to the wearer's foot in wet conditions.

6 Claims, 1 Drawing Sheet

FOOTWEAR WITH REPLACEABLE, WATERTIGHT BOOTIE

BACKGROUND OF THE INVENTION

The invention relates to footwear.

Shoes and boots are typically constructed with a permanent liner fixedly stitched within the interior to provide comfort and support. The construction of the shoe or boot and the thickness and character of its lining often depend on the particular weather conditions for which the shoe or boot is intended. For example, a boot for use in colder, wetter climates often includes a relatively thick, good insulating lining construction intended to keep the foot of the wearer comfortable and warm. Similarly, a shoe intended to be used under warmer conditions will typically have a thinner, relatively lighter lining construction.

SUMMARY OF THE INVENTION

According to one aspect of the invention, an article of footwear comprises an outer boot or shoe comprising a sole and an upper, the sole and upper together defining a volume for receiving and protecting a wearer's foot against external elements, and a replaceable, watertight bootie sized and shaped to fit snugly within the volume, the replaceable, watertight bootie comprising an insole, a bootie upper, and releasable attachment elements for releasable securement of the replaceable, watertight bootie within the volume, and the replaceable, watertight bootie further comprising a waterproofing layer of material impervious to penetration by water, thereby to provide protection to the wearer's foot in wet conditions. The invention provides a waterproof, replaceable bootie which is fitted within the interior of a shoe or boot.

Preferred embodiments of this aspect of the invention may include one or more of the following features. The waterproofing layer is an outermost layer of the bootie. The bootie further comprises sealing material fixedly attached upon an outer layer of the replaceable, watertight bootie over seams between the insole and the bootie upper, the sealing material being fabricated of a waterproof and breathable material. The bootie further comprises an inner layer fabricated of a moisture absorbing and breathable material, preferably the bootie further comprises an insulating layer disposed, and providing thermal insulation between, the inner layer and the waterproofing layer, or the further comprises a cushioning layer disposed between the inner layer and the waterproofing layer, or the bootie further comprises a charcoal-impregnated protection layer for absorbing foot odor. The bootie upper defines an open instep region, and the bootie further comprises elastic material attached to and extending across the open instep region. The article of footwear further comprises a first fastening element attached to the replaceable, watertight bootie and a second fastening element attached within the volume, the first fastener and the second fastener disposed at opposed, corresponding positions for releasable securement of the replaceable, watertight bootie within the volume. The boot or shoe is linerless.

According to another aspect of the invention, an interchangeable footwear system comprises a boot or shoe comprising a sole and an upper, the sole and upper together defining a volume for receiving and protecting a wearer's foot against external elements, and a pair of replaceable, watertight booties, each replaceable, watertight bootie sized and shaped to fit snugly within the volume and comprising an insole, a bootie upper, and releasable attachment elements for releasable securement of the replaceable, watertight bootie within the volume, at least one replaceable, watertight bootie further comprising a waterproofing layer of material impervious to penetration by water, thereby to provide protection to the wearer's foot in wet conditions.

Other advantages and features of the invention will become apparent from the following description of presently preferred embodiments, and from the claims.

DESCRIPTION OF THE PREFERRED EMBODIMENTS

Figure 1:
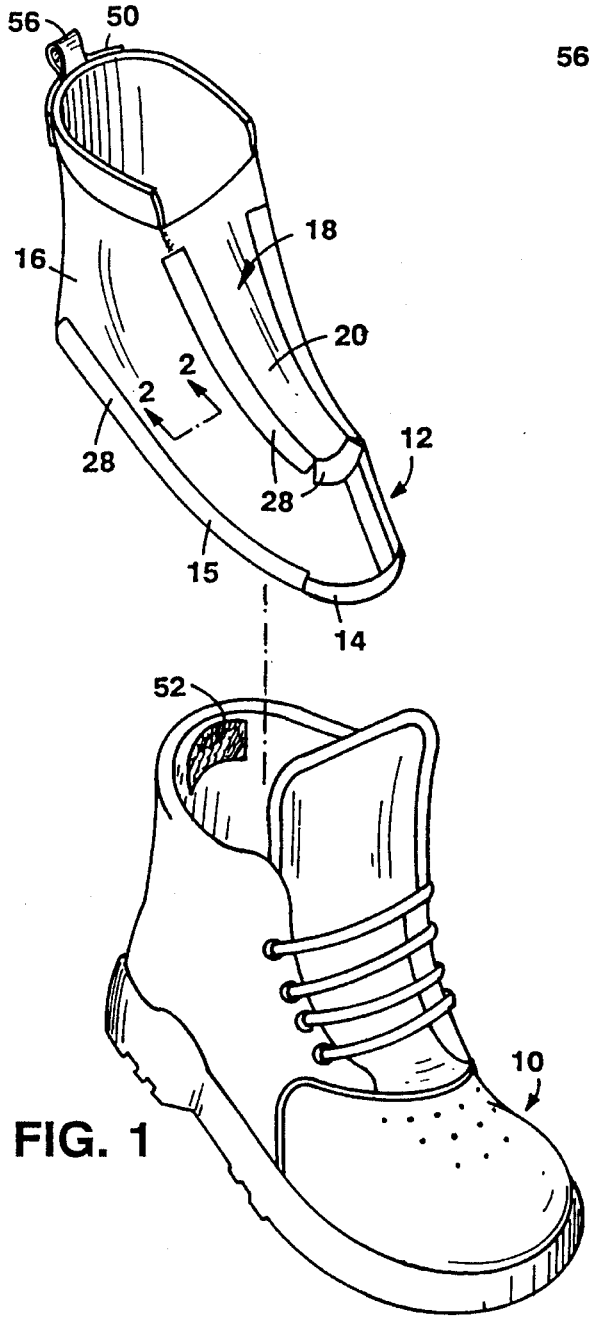
FIG. 1 is a perspective view of a boot and a replaceable, watertight (cool weather) bootie of the invention.

Referring to FIG. 1, a rugged high-top hiking boot 10 is equipped with a replaceable, watertight bootie 12 sized and shaped to fit snugly within the volume of the boot. The replaceable bootie 12 has an insole 14 and a bootie upper 16 which are sewn together along the periphery 15 of insole 14 and along a seam (not shown) extending from a rear collar portion to the heel. Bootie upper 16 has an open instep region 18 spanned by a stretchable elastic-like material 20 sewn thereacross to provide a snug fit over the foot, and to prevent slipping or riding of the bootie within the boot during use.

Figure 2:
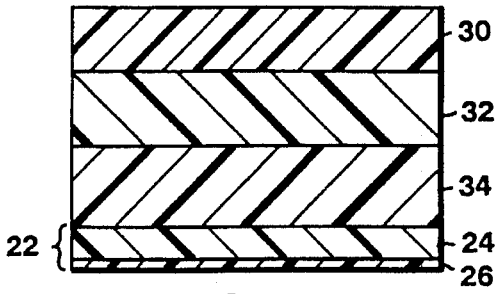
FIG. 2 is a cross-sectional view showing layers of the replaceable, watertight bootie of FIG. 1.

Bootie 12 is fabricated of materials selected to provide comfort during use in cold or wet weather. In particular, referring to FIG. 2, both insole 14 and bootie upper 16 have an outer layer 22 formed of a waterproof membrane 24 (manufactured by Gore, Inc., Elkton, Md.) selected to provide protection for the wearer's foot against water, e.g. absorbed through upper or boot 10 or otherwise collecting within the interior volume of boot. Membrane 24 is covered by a protective knitted backing 26, and sealing tape 28 (FIG. 1), e.g. fabricated from the same or similar waterproofing membrane used for outer layer 22, is heat sealed over the seams between insole 14 and bootie upper 16 to prevent moisture from penetrating through the seams of the bootie to the wearer's foot.

Insole 14 and bootie upper 16 also include an inner layer 30 formed of a fleece-like, brushed polyester material for absorbing perspiration from the foot of the wearer, with perforations to provide breathability. A channelized intermediate foam layer 32, e.g. about 2–3 millimeters thick, is positioned behind inner layer 30 to provide cushioning to the wearer's foot, and also to facilitate air circulation around the foot. Inner and cushioning layers 30, 32 may be decoratively quilted to provide an aesthetically pleasing look to the interior surface of bootie 12. Finally, an additional insulating layer 34 is provided adjacent cushioning layer 32 for keeping the wearer's foot warm by preventing thermal loss.

Figure 3:
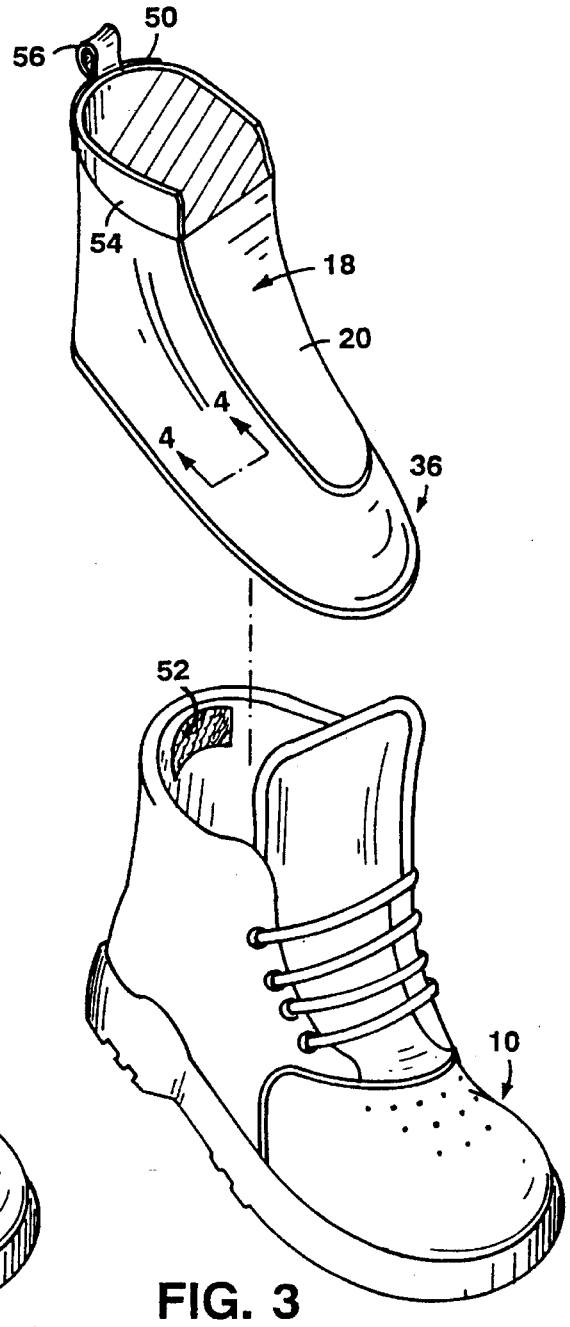
FIG. 3 is a perspective view of a boot and a replaceable, watertight (warm weather) bootie of the invention.

Referring to FIG. 3, a second replaceable, watertight bootie 36 may used interchangeably with bootie 12, e.g. in warmer weather.

Figure 4:
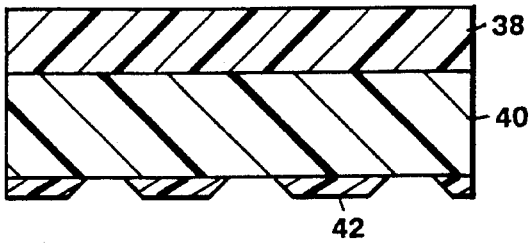
FIG. 4 is a cross-sectional view showing layers of the replaceable, watertight bootie of FIG. 3.

Referring also to FIG. 4, bootie 36 includes an inner layer 38 and an adjacent cushioning layer 40, each similar in nature to layers 30, 32, respectively, described above with respect to cold weather bootie 12. An outer layer 42, fabricated from a synthetic mesh material, is charcoal impregnated to remove foot odor. Outer layer 42 may also be impregnated with an anti-fungal or bacterial agent to prevent the growth of contagious skin diseases, for example, athlete's foot.

A replaceable, watertight bootie 12 or 36 is secured within boot 10 using corresponding, mating fasteners 50, 52, patches of hook-and-loop type fabric closure materials such as those sold under the trademark VELCRO®. A first fastener 50 is affixed to the outer, rear collar portion of bootie 12 or 36, and a mating, second fastener 52 is affixed to the inner, rear collar portion of boot 10.

A band of plastic 54 (e.g. PVC) is sewn around the ankle portion of booties 12, 36 to protect against wear and fraying. A looped tab 56 is attached to the rear collar portion of the booties to facilitate insertion of the foot within the bootie or removal of the bootie from boot 10.

other embodiments are within the following claims.

What is claimed is:

1. An interchangeable footwear system comprising:

a shoe comprising a sole and an upper, said sole and upper together defining a volume for receiving and protecting a wearer's foot against external elements, and a first replaceable bootie and a second replaceable bootie, each said replaceable bootie sized and shaped to fit snugly within said volume and each comprising a bootie sole, a bootie upper, and releasable attachment elements for releasable securement of each said replaceable bootie in turn within said volume, said first replaceable bootie comprising a waterproofing layer of material impervious to penetration by water, thereby to provide protection to the wearer's foot in wet conditions, and said second replaceable bootie comprising an inner layer fabricated of a moisture absorbing and breathable material, thereby to provide comfort to the wearer's foot in warm weather conditions, wherein said first replaceable bootie and said second replaceable bootie are interchangeably received within said shoe.

2. The article of footwear of claim 1 wherein said first replaceable bootie further comprises an inner layer fabricated of a moisture absorbing and breathable material.

3. The article of footwear of claim 2 wherein said second replaceable bootie further comprises a charcoal-impregnated protection layer for absorbing foot odor.

4. The article of footwear of claim 1 wherein said bootie upper of at least one of said first replaceable bootie and said second replaceable bootie defines an open instep region, and further comprises elastic material attached to and extending across said open instep region.

5. The article of footwear of claim 1 further comprising first fastening elements attached to each said first replaceable bootie and said second replaceable bootie, and a cooperating second fastening element attached within said volume, each said first fastener and said second fastener disposed at opposed, corresponding positions for releasable interengagement for securement of said replaceable booties in turn within said volume.

6. The article of footwear of claim 1 wherein said shoe is linerless.

* * * * *